US006592364B2

(12) United States Patent
Zapata et al.

(10) Patent No.: US 6,592,364 B2
(45) Date of Patent: Jul. 15, 2003

(54) APPARATUS, METHOD AND SYSTEM FOR INDEPENDENTLY CONTROLLING AIRFLOW IN A CONVEYOR OVEN

(76) Inventors: David Zapata, 729 Third Ave., Dallas, TX (US) 75226; Charles Kingdon, 816 Canongate Dr., Flower Mound, TX (US) 75022; John Gilleland, 729 Third Ave., Dallas, TX (US) 75226

( * ) Notice: Subject to any disclaimer, the term of this patent is extended or adjusted under 35 U.S.C. 154(b) by 0 days.

(21) Appl. No.: 09/947,727

(22) Filed: Nov. 30, 2001

(65) Prior Publication Data

US 2003/0104334 A1 Jun. 5, 2003

(51) Int. Cl.[7] ..... F27B 9/10

(52) U.S. Cl. ..... 432/145; 126/21 A; 99/443 R; 99/443 C

(58) Field of Search ..... 432/121, 144, 432/145, 152, 196, 201; 126/21 A; 99/373, 386, 389, 443 R, 443 C, 474, 475, 476, 477

(56) References Cited

U.S. PATENT DOCUMENTS

| | | | | |
|---|---|---|---|---|
| 3,981,708 | A | | 9/1976 | Loeffler et al. |
| 3,999,475 | A | | 12/1976 | Roderick |
| 4,062,983 | A | | 12/1977 | Roderick |
| 4,154,861 | A | | 5/1979 | Smith |
| 4,157,018 | A | | 6/1979 | Goltsos |
| 4,210,072 | A | | 7/1980 | Pedrini |
| 4,251,549 | A | | 2/1981 | Fournet et al. |
| 4,252,055 | A | | 2/1981 | Johansson et al. |
| 4,289,792 | A | | 9/1981 | Smith |
| 4,338,911 | A | | 7/1982 | Smith |
| 4,377,109 | A | | 3/1983 | Brown et al. |
| 4,378,729 | A | | 4/1983 | Pierick |
| 4,384,513 | A | | 5/1983 | Pierick |
| 4,389,562 | A | | 6/1983 | Chadoir |
| 4,395,233 | A | | 7/1983 | Smith et al. |
| 4,409,453 | A | | 10/1983 | Smith |
| 4,415,323 | A | | 11/1983 | Osrow et al. |
| 4,462,383 | A | | 7/1984 | Henke et al. |
| 4,464,406 | A | | 8/1984 | Pierick |
| 4,471,000 | A | | 9/1984 | Brown et al. |
| 4,479,776 | A | * | 10/1984 | Smith ..... 432/144 |
| 4,503,760 | A | | 3/1985 | Pryputsch et al. |
| 4,516,012 | A | | 5/1985 | Smith et al. |
| 4,555,605 | A | | 11/1985 | Brown et al. |
| 4,556,046 | A | | 12/1985 | Riffel et al. |
| 4,576,090 | A | * | 3/1986 | Burtea ..... 99/443 C |
| 4,585,661 | A | | 4/1986 | Brummett |
| 4,591,333 | A | | 5/1986 | Henke |
| 4,612,431 | A | | 9/1986 | Brown et al. |
| 4,615,014 | A | | 9/1986 | Gigandet et al. |
| 4,616,562 | A | | 10/1986 | Kuechler |
| 4,676,151 | A | | 6/1987 | Gorsuch et al. |
| 4,700,685 | A | | 10/1987 | Miller |
| 4,701,340 | A | | 10/1987 | Bratton et al. |
| 4,742,203 | A | | 5/1988 | Brown et al. |
| 4,749,581 | A | | 6/1988 | Gorsuch et al. |
| 4,751,911 | A | | 6/1988 | Betts et al. |
| 4,753,215 | A | * | 6/1988 | Kaminski et al. ..... 126/21 A |
| 4,757,800 | A | | 7/1988 | Shei et al. |
| 4,758,442 | A | | 7/1988 | Wells |
| 4,781,169 | A | | 11/1988 | Henke et al. |
| 4,800,865 | A | | 1/1989 | Setzer |
| 4,817,509 | A | | 4/1989 | Erickson |
| 4,846,143 | A | | 7/1989 | Csadenyi |

(List continued on next page.)

OTHER PUBLICATIONS

US 4,421,018, 12/1983, Pryputsch et al. (withdrawn)

*Primary Examiner*—Gregory Wilson
(74) *Attorney, Agent, or Firm*—Gardere Wynne Sewell LLP; Kay Lyn Schwartz; Kenneth T. Emanuelson

(57) ABSTRACT

The present invention is an apparatus for distributing air to different regions of a conveyor oven. The apparatus has comprising one or more blowers to distribute the air. A lower plenum is connected to a blower. The lower plenum directs air to the lower side of a conveyor within the oven. An upper plenum is connected to a blower. The upper plenum directs air to the upper side of the conveyor.

12 Claims, 3 Drawing Sheets

U.S. PATENT DOCUMENTS

| | | | | |
|---|---|---|---|---|
| 4,873,107 | A | | 10/1989 | Archer |
| 4,881,519 | A | | 11/1989 | Henke |
| 4,884,552 | A | | 12/1989 | Wells et al. |
| 4,896,657 | A | | 1/1990 | Glassman |
| 4,902,316 | A | | 2/1990 | Giles et al. |
| 4,910,880 | A | | 3/1990 | Cole |
| 4,912,338 | A | | 3/1990 | Bingham |
| 4,919,477 | A | | 4/1990 | Bingham et al. |
| 4,922,626 | A | | 5/1990 | Fiddler |
| 4,924,763 | A | | 5/1990 | Bingham |
| 4,944,285 | A | | 7/1990 | Glassman |
| 4,951,645 | A | | 8/1990 | Luebke et al. |
| 4,951,648 | A | * | 8/1990 | Shukla et al. ..... 126/21 A |
| 4,960,100 | A | | 10/1990 | Pellicane |
| 4,960,977 | A | | 10/1990 | Alden |
| 4,964,392 | A | | 10/1990 | Bruno |
| 4,965,435 | A | | 10/1990 | Smith et al. |
| 4,972,824 | A | | 11/1990 | Luebke et al. |
| 5,012,071 | A | | 4/1991 | Henke |
| 5,025,775 | A | | 6/1991 | Crisp |
| 5,050,578 | A | | 9/1991 | Luebke et al. |
| 5,066,851 | A | | 11/1991 | Darvin |
| 5,078,050 | A | | 1/1992 | Smith |
| 5,107,097 | A | | 4/1992 | Negandhi |
| 5,110,614 | A | | 5/1992 | Corbin et al. |
| 5,131,841 | A | | 7/1992 | Smith et al. |
| 5,140,119 | A | | 8/1992 | Brown et al. |
| 5,147,994 | A | | 9/1992 | Smith et al. |
| 5,155,318 | A | | 10/1992 | Bowen |
| 5,161,889 | A | | 11/1992 | Smith et al. |
| 5,165,328 | A | | 11/1992 | Erickson et al. |
| 5,172,328 | A | | 12/1992 | Cahlander et al. |
| 5,172,682 | A | | 12/1992 | Luebke et al. |
| 5,179,265 | A | | 1/1993 | Sheridan et al. |
| 5,180,898 | A | | 1/1993 | Alden et al. |
| 5,182,426 | A | | 1/1993 | Sklenak et al. |
| 5,204,503 | A | | 4/1993 | Maiellano et al. |
| 5,205,274 | A | | 4/1993 | Smith et al. |
| 5,210,387 | A | | 5/1993 | Smith et al. |
| 5,223,290 | A | | 6/1993 | Alden |
| 5,231,920 | A | | 8/1993 | Alden et al. |
| 5,239,917 | A | | 8/1993 | Lutkie et al. |
| 5,243,899 | A | | 9/1993 | Moshier et al. |
| 5,244,020 | A | | 9/1993 | Bruno et al. |
| 5,254,823 | A | | 10/1993 | McKee et al. |
| 5,266,345 | A | | 11/1993 | Corbin et al. |
| 5,270,502 | A | | 12/1993 | Brown et al. |
| 5,272,299 | A | | 12/1993 | Ovadia |
| 5,272,302 | A | | 12/1993 | Dudley et al. |
| 5,277,105 | A | | 1/1994 | Bruno et al. |
| 5,277,924 | A | | 1/1994 | Padilla |
| 5,285,604 | A | | 2/1994 | Carlin |
| 5,310,978 | A | | 5/1994 | Smith et al. |
| 5,320,334 | A | | 6/1994 | DeAngelis |
| 5,338,008 | A | * | 8/1994 | Okuno et al. ..... 432/152 |
| 5,345,923 | A | | 9/1994 | Luebke et al. |
| 5,352,473 | A | | 10/1994 | Chiqurupati et al. |
| 5,365,918 | A | | 11/1994 | Smith et al. |
| 5,387,781 | A | | 2/1995 | Berkoff |
| 5,398,666 | A | | 3/1995 | Smith et al. |
| 5,401,940 | A | | 3/1995 | Smith et al. |
| 5,403,607 | A | | 4/1995 | Erickson et al. |
| 5,404,808 | A | | 4/1995 | Smith et al. |
| 5,421,316 | A | | 6/1995 | Heber et al. |
| 5,421,317 | A | | 6/1995 | Cole et al. |
| 5,421,320 | A | | 6/1995 | Brown |
| 5,423,248 | A | | 6/1995 | Smith et al. |
| 5,433,966 | A | | 7/1995 | Wolt et al. |
| 5,434,390 | A | | 7/1995 | McKee et al. |
| 5,449,888 | A | | 9/1995 | Smith et al. |
| 5,454,295 | A | | 10/1995 | Cox et al. |
| 5,458,051 | A | | 10/1995 | Alden et al. |
| 5,465,651 | A | | 11/1995 | Erickson et al. |
| 5,473,975 | A | | 12/1995 | Bruno et al. |
| 5,484,621 | A | | 1/1996 | Erickson et al. |
| 5,497,760 | A | | 3/1996 | Alden et al. |
| 5,507,382 | A | | 4/1996 | Hartwell et al. |
| 5,510,601 | A | | 4/1996 | Smith et al. |
| 5,513,558 | A | | 5/1996 | Erickson et al. |
| D370,373 | S | | 6/1996 | Brown et al. |
| 5,533,806 | A | | 7/1996 | Veltrop et al. |
| 5,539,187 | A | | 7/1996 | Smith et al. |
| 5,556,201 | A | | 9/1996 | Veltrop et al. |
| 5,558,793 | A | | 9/1996 | McKee et al. |
| 5,568,802 | A | | 10/1996 | Buday et al. |
| 5,572,984 | A | | 11/1996 | Alden et al. |
| 5,577,438 | A | | 11/1996 | Amitrano et al. |
| 5,582,093 | A | | 12/1996 | Amitrano et al. |
| 5,582,758 | A | | 12/1996 | Smith et al. |
| 5,584,237 | A | | 12/1996 | Moshonas |
| 5,601,070 | A | | 2/1997 | Hotard et al. |
| 5,609,983 | A | | 3/1997 | Kawamura et al. |
| 5,619,983 | A | | 4/1997 | Smith |
| 5,620,731 | A | | 4/1997 | McKee |
| 5,639,232 | A | | 6/1997 | Bogenschutz et al. |
| 5,671,660 | A | | 9/1997 | Moshonas et al. |
| 5,673,681 | A | | 10/1997 | Neitzel et al. |
| 5,676,044 | A | | 10/1997 | Lara |
| 5,676,051 | A | | 10/1997 | Sinemus |
| 5,676,870 | A | | 10/1997 | Wassman et al. |
| 5,683,240 | A | | 11/1997 | Smith et al. |
| 5,688,423 | A | | 11/1997 | Rudewicz et al. |
| 5,699,722 | A | | 12/1997 | Erickson et al. |
| 5,726,423 | A | | 3/1998 | Westerberg et al. |
| 5,728,416 | A | | 3/1998 | Bono et al. |
| 5,782,174 | A | | 7/1998 | Cohn et al. |
| 5,799,822 | A | | 9/1998 | Rudewicz et al. |
| 5,802,963 | A | | 9/1998 | Cohn et al. |
| 5,818,014 | A | | 10/1998 | Smith et al. |
| 5,832,812 | A | * | 11/1998 | Wolfe et al. ..... 99/443 C |
| 5,850,780 | A | | 12/1998 | Mascia et al. |
| 5,864,120 | A | | 1/1999 | Vroom et al. |
| 5,869,812 | A | | 2/1999 | Creamer et al. |
| 5,873,300 | A | | 2/1999 | Kuhlman |
| 5,906,485 | A | | 5/1999 | Groff et al. |
| 5,921,170 | A | | 7/1999 | Khatchadourian et al. |
| 5,927,265 | A | | 7/1999 | McKee et al. |
| 5,927,598 | A | | 7/1999 | Broe |
| 5,937,740 | A | | 8/1999 | Kubota et al. |
| 5,942,265 | A | | 8/1999 | Roberds et al. |
| 5,958,271 | A | | 9/1999 | Westerberg et al. |
| 5,968,388 | A | | 10/1999 | Creamer |
| 5,975,348 | A | | 11/1999 | Rudewicz et al. |
| 5,986,249 | A | | 11/1999 | Yoshino et al. |
| 5,988,154 | A | | 11/1999 | Douglas et al. |
| 5,990,454 | A | | 11/1999 | Westerberg et al. |
| 6,013,900 | A | | 1/2000 | Westerberg et al. |
| 6,041,774 | A | | 3/2000 | Ward et al. |
| 6,049,066 | A | | 4/2000 | Wilson |
| 6,054,697 | A | | 4/2000 | Woodward et al. |
| 6,058,924 | A | | 5/2000 | Pool et al. |
| 6,060,701 | A | | 5/2000 | McKee et al. |
| 6,086,934 | A | | 7/2000 | Khatchadourian |
| 6,107,605 | A | | 8/2000 | Creamer et al. |
| 6,121,578 | A | | 9/2000 | Owens et al. |
| 6,140,626 | A | | 10/2000 | McKee et al. |
| 6,156,356 | A | | 12/2000 | King et al. |
| 6,171,630 | B1 | | 1/2001 | Stanger et al. |
| 6,172,348 | B1 | | 1/2001 | Yoshino et al. |
| 6,173,710 | B1 | | 1/2001 | Gibson et al. |
| 6,175,100 | B1 | | 1/2001 | Creamer et al. |

(List continued on next page.)

APPARATUS, METHOD AND SYSTEM FOR INDEPENDENTLY CONTROLLING AIRFLOW IN A CONVEYOR OVEN

FIELD OF THE INVENTION

The present invention relates to conveyor ovens and, more particularly to, an improved conveyor oven having distinct heated air plenums that may be independently controlled to modify the cooking characteristics of the conveyor oven.

BACKGROUND OF THE INVENTION

Many restaurants use conveyor ovens to prepare food. Conveyor ovens typically cook or heat food by forced convection. A food service professional may place food such as a pizza or a dish of lasagna, for example, on the conveyor and the food is cooked or heated as it is conveyed through heated air within the oven.

Because customers like to have their meals prepared quickly, time is an important factor to consider when cooking food in conveyor ovens. The conveyor speed may be increased to quickly move food through the oven. The heat imparted to the food however, must also be increased or the food will remain cold and not satisfactory to customers. Simply increasing the temperature of the forced air in the oven is not necessarily an effective solution because the food is more likely to burn in high temperature air. Food service professionals may encounter problems when attempting to balance conveyor speed and oven air temperature to quickly and effectively cook or heat food.

Food service professionals encounter additional problems when preparing foods that require specialized cooking. Some pizzas, for example, are generally preferred if they have a crispy crust and a melted cheese topping. Cooking pizzas in this manner requires higher heat on the bottom of the pizza to properly cook the crust and controlled heat on the top of the pizza to melt, but not bun, the cheese topping. Because the conveyor oven has one open cooking chamber, independently controlling temperatures above and below a food may be difficult or impossible in conventional conveyor ovens.

Some conveyor ovens have manual balancing vents that allow food service professionals to adjust the amount of outside air that enters the Cooking chamber of a conveyor oven. Introducing outside air to the cooking chamber reduces the air temperature within the chamber. Restricting outside air to the cooking chamber increases the air temperature within the chamber. Adversely, however, adjusting the conveyor oven to properly cook a particular food is a process of trial and error. Several iterations, which could result in wasted food, may be required to properly adjust the conveyor oven.

Manual balancing vents also have many other problems. If conditions such as the ambient room temperature or the quantity of the food change, the food service professional must make additional adjustments to the vents, which consumes time and, if improperly adjusted, could result in wasted food. Because adjusting the ovens is more an art than a science, training new food service personnel is a costly process. Additionally, the vents are often rudimentary sheet metal plates that selectively cover holes in the oven. The plates do not accurately meter outside air and also become very hot, which may be hazardous to the food service professional. Necessary repeated adjustment of the vents increases the chance of a serious burn.

It would, therefore, be desirable to have an improved conveyor oven that does not improperly cook foods. It would also be desirable to have an improved conveyor oven that does not require difficult or uncertain adjustments to properly cook food. Further, it would be desirable to have an improved conveyor oven that does not require highly trained personnel to properly cook food.

SUMMARY OF THE INVENTION

The present invention is an apparatus for distributing air to different regions of a conveyor oven. The apparatus has comprising one or more blowers to distribute the air. A lower plenum is connected to a blower. The lower plenum directs air to the lower side of a conveyor within the oven. An upper plenum is connected to a blower. The upper plenum directs air to the upper side of the conveyor.

In one embodiment of the invention, a method of distributing air to different regions of a conveyor oven has the step of providing one or more blowers. A lower plenum is provided and attached to the one or more blowers. The lower plenum distributes air at the lower portion of a conveyor in a conveyor oven. An upper plenum is provided and attached to the one or more blowers. The upper plenum distributes air at the upper portion of the conveyor. Independently controlling the one or more blowers controls the volume of air that is distributed by the lower plenum and the upper plenum.

In another embodiment of the invention, a system to independently and variably control the temperature profile of a conveyor oven has a conveyor oven that has a cooking chamber. The system also has one or more independently controllable blowers. Plenums attached to the blowers distribute air to the cooking chamber. Independently controllable heating elements heat the air distributed by the plenums.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention is discussed in detail below, it should be appreciated that the present invention provides many applicable inventive concepts that can be embodied in a wide variety of specific contexts. The specific embodiments discussed herein are merely illustrative of specific ways to make and use the invention, and do not delimit the scope of the invention.

A conveyor oven according to one embodiment of the present invention has many useful advantages over a typical conveyor oven. Typical conveyor ovens have an entrance and an exit. Food is placed on the conveyor at the entrance; it is carried through heated air in the cooking chamber; and, presumably, the food exits in a cooked state. As discussed above, a plenum may distribute heated air to the cooking chamber. Conventional ovens however, cannot effectively control the characteristics of air distributed within the oven. For example, a typical conveyor oven cannot control the manner in which different portions of the food are cooked. Consequently, conventional ovens may burn the top portion of the food while the bottom portion of the food exits the oven undercooked. A conveyor oven having the improvements described in detail below overcomes this and other disadvantages of conventional ovens.

Figure 1:
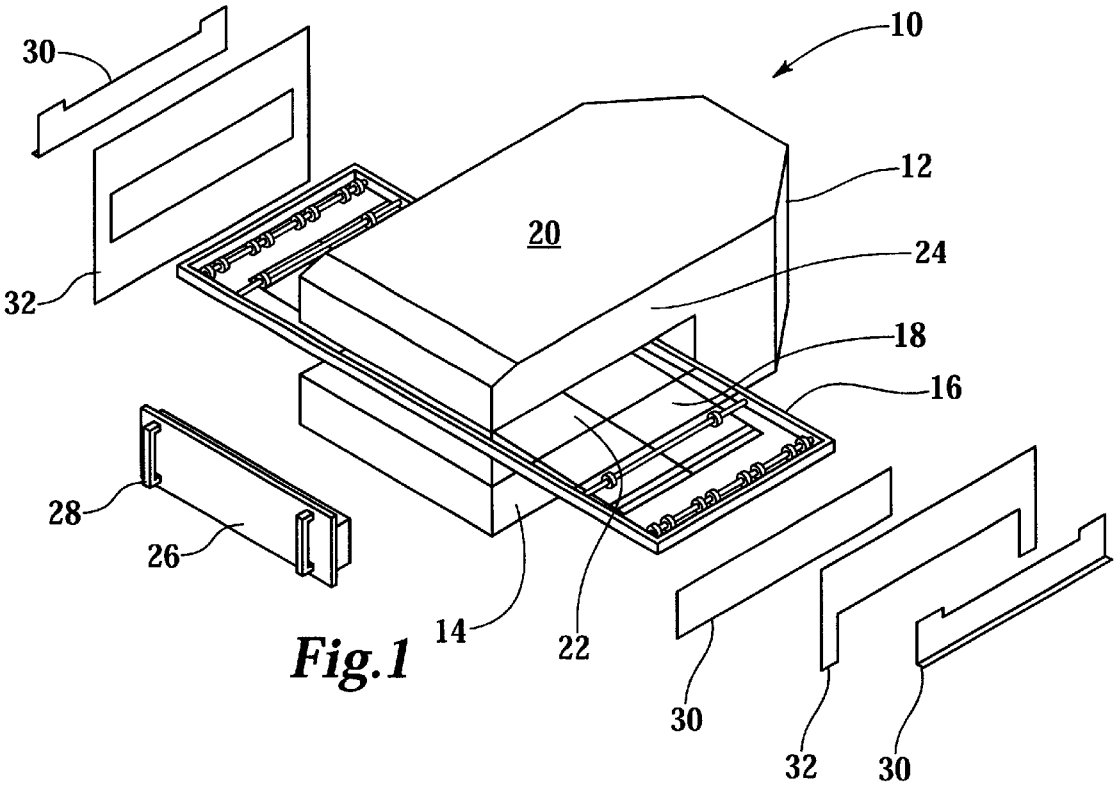
FIG. 1 is a perspective exploded view of a conveyor oven that depicts an embodiment of the present invention.
Figure 1A:
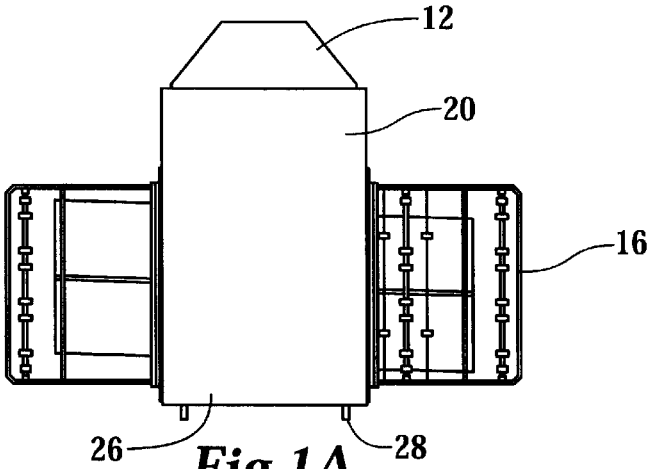
FIGS 1A-1C are principal axis views of the conveyor oven of FIG. 1.
Figure 1B:
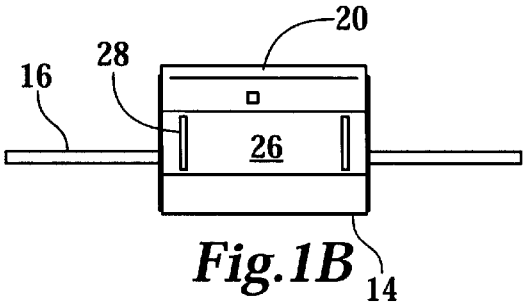
Figure 1C:
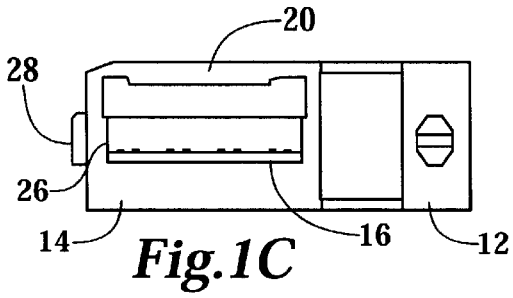

As depicted in FIG. 1 and FIGS. 1A-1C, an oven 10 has a housing 12. The housing 12 may house various components of the oven 10 such as plenum housings, heating elements, blowers, a power supply, switches, motors and the like. The housing 12 may be fabricated from stainless steel or other suitable material such as aluminum or carbon fiber. The housing 12 may be formed by a brake or fabricated from multiple pieces and bolted, screwed or welded together. The housing 12 may rest directly on a countertop or table or may have adjustable feet (not shown) to compensate for uneven surfaces.

A base 14 is attached to the lower portion of the housing 12. The base 14 may be welded, bolted or screwed to the housing 12. Similar to the housing 12, the base 14 may also be fabricated from stainless steel, aluminum or other suitable material for the food service industry. The base 14 may impart additional stability to the oven 10 by distributing the weight of the oven 10 over a larger area. The dimensions of the base 14 will generally define the size of the oven 10. Smaller capacity ovens 10 will usually have a smaller base 14, whereas larger capacity ovens 10 will usually have a larger base 14.

The base 14 provides support for a conveyor 16. The conveyor 16 may be a wire mesh that conveys food through the oven 10. A motor within the housing 12 typically drives the conveyor 16 but the conveyor 16 may also be driven by an external drive or other drive that is housed within the conveyor 16. Alternative methods of driving the conveyor 16 will be apparent to those having ordinary skill in the art of conveyor ovens.

The base 14 may also support one or more lower plenums 18. The lower plenums 18 deliver heated air or gasses to the lower side of a food that is cooked in the oven 10. The lower plenums 18 may be fabricated from stainless steel, aluminum, molded plastic or other material that is suitable to channel heated air or gasses. The lower plenums 18 may simply rest on the base 14 or interlock into the base 14, the housing 12, or a plenum housing (described below). The lower plenums 18 may be easily removable from the oven 10 to facilitate cleaning and maintaining the oven 10. The lower plenums 18 will be described in greater detail below.

A top 20 is attached to an upper portion of the housing 12. The top 20 may be fabricated from materials such as stainless steel, aluminum or other materials known in the art of oven manufacturing. The size of the top 20 may have dimensions similar to the dimensions of the base 14. The volume of space between the base 14 and the top 20 generally defines a chamber 22 of the oven 10. The size of the chamber 22 determines the size of the conveyor 16 and ultimately determines the size or amount of food that may be cooked in the oven 10 during a particular time. Different sizes of ovens 10 may be manufactured by varying the lengths and widths of the top 20 and base 14 and varying the distance between the top 20 and the base 14.

One or more baffles 30 may be removably attached to the top 20 or other portion of the oven 10 to contain and redirect heated air or gasses within the chamber 22. The baffles 30 may help prevent heated air or gasses from escaping through the entrance or exit of the oven 10, and thereby improve the efficiency of the oven 10 and the environment of a user. The baffles 30 may be removed from the front of the oven 10 to facilitate cleaning the chamber 22. One or more side covers 32 may also be removably attached to the top 20 or other portion of the oven 10. The side covers 32 may be insulated to help protect users from injuries caused by hot surfaces on the oven 10.

The top 20 may support one or more upper plenums 24. The upper plenums 24 deliver heated air or gasses to the upper side of food that is cooked in the oven 10. The upper plenums 24 may also deliver heated air or gasses to the chamber 22 to thoroughly cook the entire food rather than cook only a particular region of the food, such as the top of a pizza, for example. The upper plenums 24 may be fabricated from stainless steel, aluminum, molded plastic or other material that is suitable to channel heated air or gasses. The upper plenums 24 may interlock into the top 20, the housing 12, or the plenum housing (described below). The upper plenums 24 may be easily removable from the oven 10 to facilitate cleaning and maintaining the oven 10.

Figure 2:
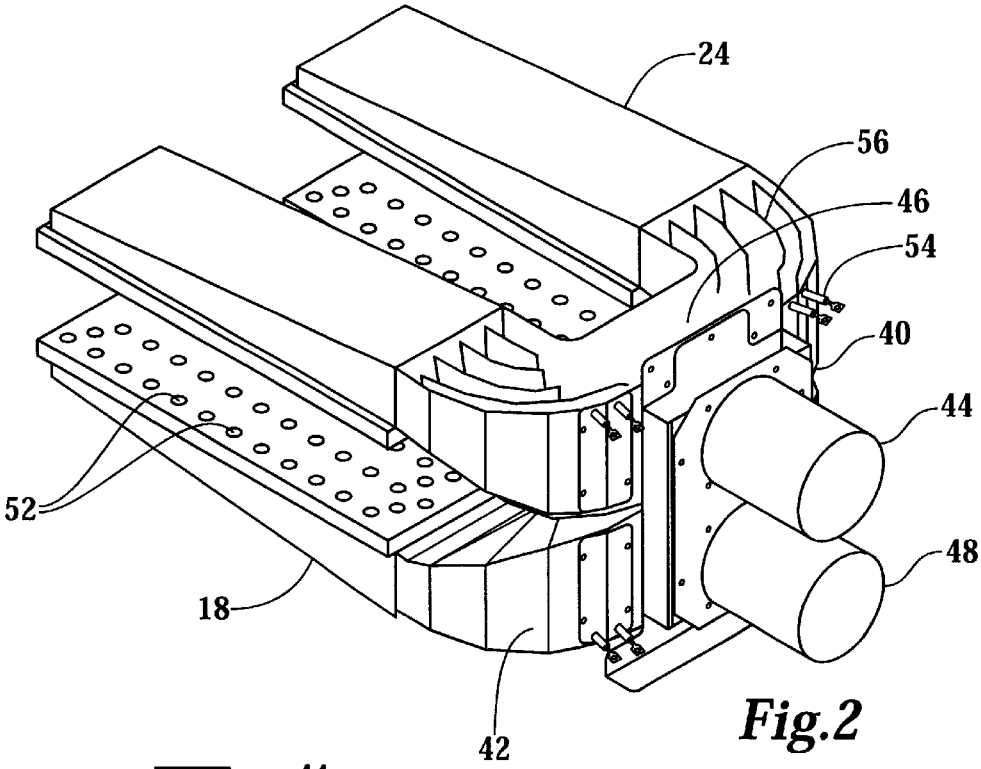
FIG. 2 is perspective view of a plenum assembly that depicts an embodiment of the present invention.
Figure 2A:
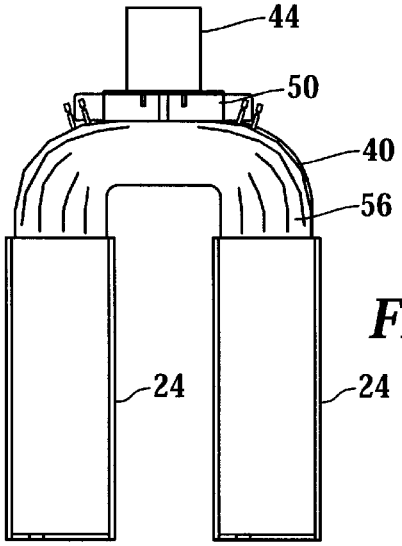
FIGS. 2A-2C are principal axis views of the plenum assembly of FIG. 2.
Figure 2B:
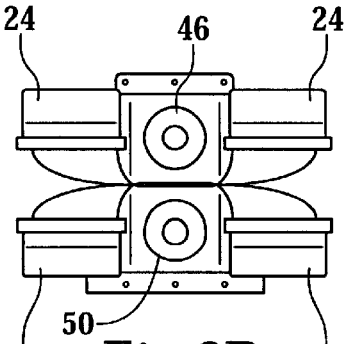
Figure 2C:
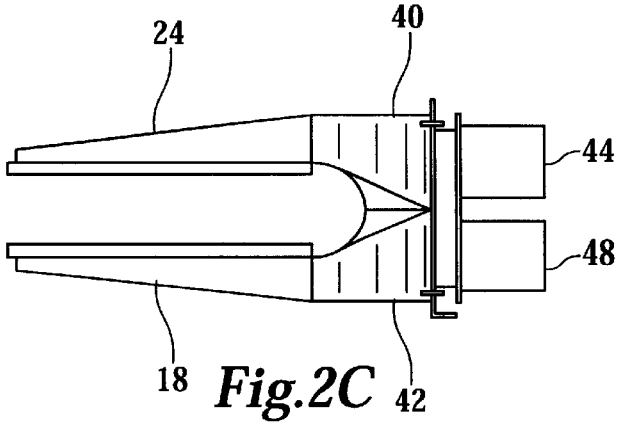

Referring now to FIG. 2 and FIGS. 2A-2C, a plenum assembly includes an upper plenum housing 40 and a lower plenum housing 42. An upper motor 44 within the upper plenum housing 40 drives an upper blower 46. Similarly, a lower blower motor 48 drives a lower blower 50. Separate motors 44, 48 may be independently controlled to differentiate airflow between the upper plenum 24 and the lower plenum 18. Independently controlled airflow allows a user to more precisely control the cooking process. For example, more air, at a higher temperature, may be directed to the through the lower plenum 18 to most effectively cook and crisp the crust of a pizza. During the same cooking process, less air, at a lower temperature, may be directed through the upper plenum 24 to properly heat pizza toppings and melt cheese on the pizza. If the same temperature air were directed to both upper and lower surfaces of the pizza, the crust could be undercooked or the cheese could be burned.

The blowers 46, 50 within the housing 12 may force the heated air or gasses into the plenums 18, 24. The plenums 18, 24 may be tapered towards their distal ends to maintain air or gas velocity along the length of the plenums 18, 24. The heated air or gasses may be discharged from the plenums 18, 24 through a series of distribution ports 52 in the lower surface of the upper plenum 24 and the upper surface of the lower plenum 18. The series of distribution ports 52 may be sized and arranged to deliver an appropriate volume of heated air or gasses and properly cook food within the oven 10. Heated air or gasses from the upper plenum 24 may be directed to impinge on the upper surface of the food while heated air or gasses from the lower plenum 18 may be directed to impinge on the lower surface of the food. This directional distribution of heated air or gasses aids in cooking separate portions of foods such as the meat or cheese toppings on a pizza, for example.

Figure 3:
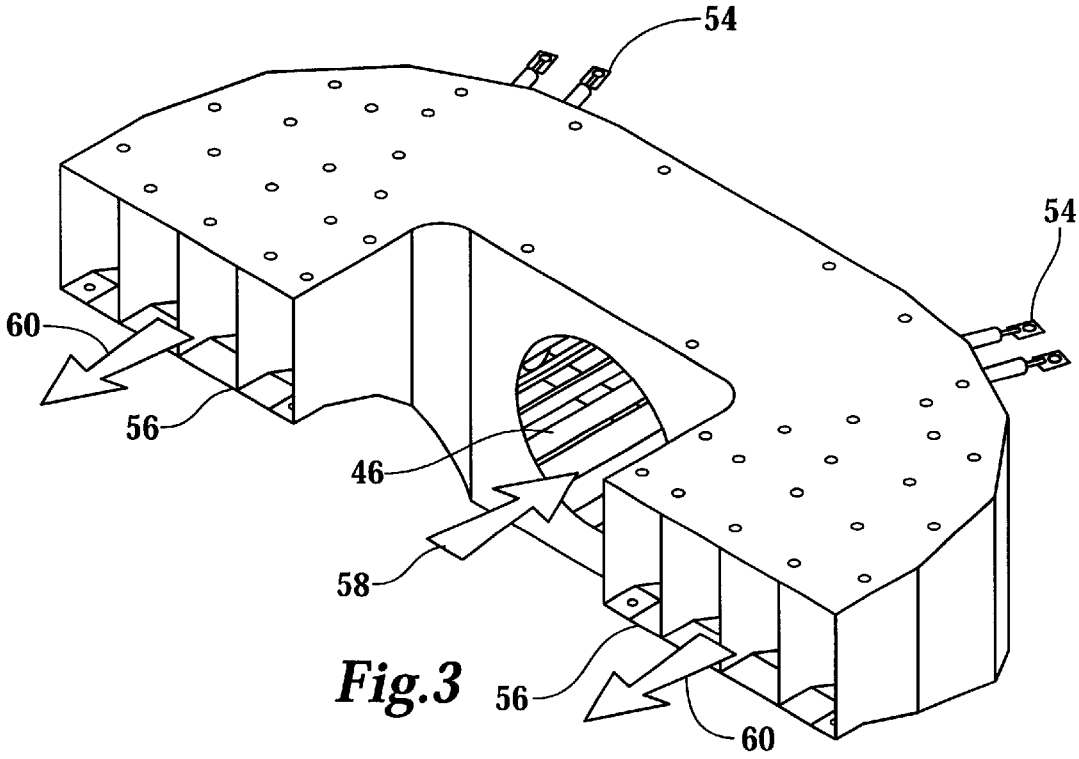
FIG. 3 is a cut-away view of a plenum housing that depicts an embodiment of the present invention.
Figure 3A:
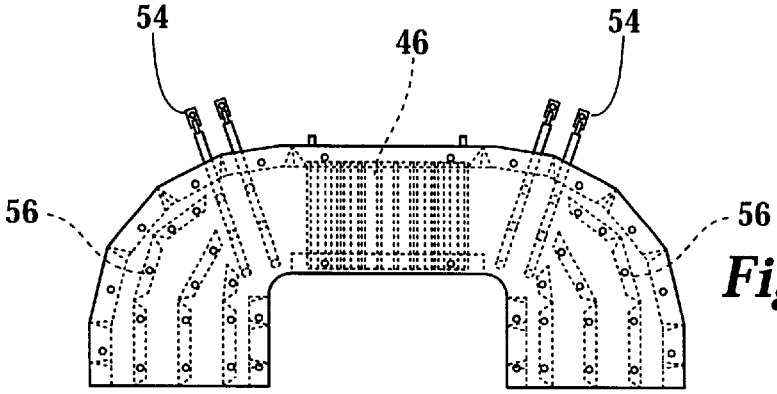
FIGS. 3A-3C are principal views of the plenum assembly of FIG. 3.
Figure 3B:
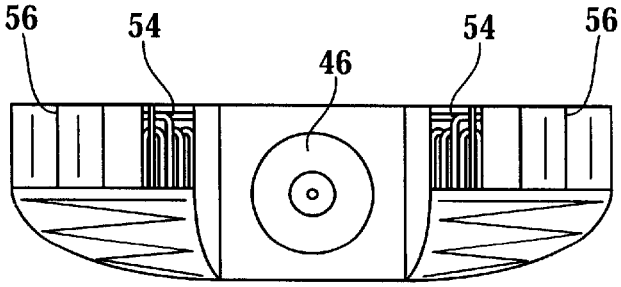
Figure 3C:
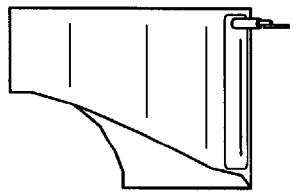

Turning now to FIG. 3 and FIGS. 3A-3C, a cutaway view of the upper plenum housing 40 is depicted in detail. Although the upper plenum housing 40 is depicted, the lower plenum housing 42 functions in a similarly and both upper and lower components will be discussed with reference to FIG. 3. The blowers 46, 50 may draw air from the oven chamber 22 as shown generally by arrow 58. Upon starting the oven 10, ambient air will be drawn through the entrance and exit of the oven 10 into the blowers 46, 50. The air may then be distributed into the plenum housings 40, 42. The plenum housings 40, 42 have a heating element 54 within the air path to heat air that is moved by the blowers 46, 50. The heating element 54 may heat the air by electrical resistance, combustion, or infrared heating, for example. Other components to heat the air within the oven 10 will be apparent to those having ordinary skill in oven design.

Each branch of the plenum housings 40, 42 may have a separate heating element 54. Each heating element 54 may be independently controlled to deliver different a temperature air to different regions of the chamber 22. For example, in an oven 10 that has front and rear branches of the plenums 18, 24, air to each of the branches of the plenums 18, 24 may be heated to a different temperature according to the cooking characteristics of a particular food. Consequently, different temperature air may be directed to different regions of the chamber 22.

Additionally, the heating elements 54 and the speed of the blowers 46, 50 may be simultaneously controlled by a computer processor (not shown) to more precisely control the temperature profile of the chamber 22. A series of thermocouples (not shown) placed within the chamber 22 may monitor the oven temperature in real-time. The computer processor may compare the information from the thermocouples to a desired temperature profile and adjust the output of the blowers 46, 50 and the heating elements 54 accordingly. Other methods of controlling the temperature profile within the chamber 22 will be apparent to those having ordinary skill in control theory.

After the air is forced over the heating element 54, the air continues to flow through the plenum housings 40, 42 and is delivered to the plenums 18, 24. Arrows 60 generally designate this airflow from the plenum housings 40, 42. The airflow may be collimated by a series of vanes 56 within the plenum housings 40, 42. The vanes 56 may be thin strips of metal, plastic, or other suitable material that are spot welded, screwed, glued or otherwise fastened in the flow path of the air. The vanes 56 are designed to redirect, distribute and equalize airflow across the cross section of the plenum housings 40, 42 and the plenums 18, 24. Collimated air is more efficiently delivered through the plenums 18, 24 and, consequently, into the chamber through the distribution ports 52. As a result, the vanes 56 alter airflow characteristics to improve heat distribution within the chamber 22.

Heated air circulates within the chamber 22 and cooks or heats the food on the conveyor 16. Because the blowers 46, 50 draw air from the chamber 22, the blowers 46, 50 draw heated air after the oven 10 has been operating for a period of time and the heating elements 54 impart additional heat to the air. If the heating elements 54 and the blowers 46, 50 are operated at a steady rate, the temperature, within the chamber 22 will eventually reach a state of equilibrium. Varying environmental conditions such as room temperature changes and the addition of cold food products to the chamber 22 will alter the temperature profile of the chamber 22. Independent and variably controllable heating elements 54 may add or reduce heating to compensate for changes in a proper temperature profile. Consequently, food may be properly cooked in a consistent manner.

Whereas the invention has been shown and described in connection with the preferred embodiment thereof, it will be understood that many modifications, substitutions and additions may be made which are within the intended broad scope of the appended claims. There has therefore been shown and described an improved conveyor oven that accomplishes at least all of the above stated advantages.

What is claimed is:

1. An apparatus for distributing air to different regions of a conveyor oven comprising:

one or more blowers;

a lower plenum connected to the one or more blowers, for directing air to the lower side of a conveyor within the oven;

an upper plenum, having an upper front plenum branch to direct air to the beginning of the conveyor and a upper rear plenum branch to direct air to the end of the conveyor, connected to the one or more blowers, for directing air to the upper side of the conveyor;

an upper front heating element to heat air directed by the upper plenum front plenum branch; and an upper rear heating element to heat air directed by the upper plenum rear plenum branch.

2. The apparatus of claim 1 wherein the lower plenum has a lower front plenum branch to direct air towards the beginning of the conveyor and a lower rear plenum branch to direct air towards the end of the conveyor.

3. The apparatus of claim 3 further comprising a lower front heating element to heat air directed by the lower front plenum branch and a lower rear heating element to heat air directed by the lower rear plenum branch.

4. The apparatus of claim 1 wherein the lower plenum further comprises one or more heating elements to heat the air.

5. A method of distributing air to different regions of a conveyor oven comprising the steps of:

providing one or more lower blowers;

providing one or more upper blowers;

providing a lower plenum attached to a lower blower, the lower plenum for distributing air at the lower portion of a conveyor in a conveyor oven;

providing an upper plenum attached to an upper blower, the upper plenum for distributing air at the upper portion of the conveyor; and independently controlling the one or more blowers to control the volume of air that is distributed by the lower plenum and the upper plenum.

6. The method of claim 5 further comprising the step of providing a heating element to heat the distributed air.

7. The method of claim 5 wherein the upper plenum has a front plenum branch to distribute air to the beginning of the conveyor and a rear plenum branch to distribute air to the end of the conveyor.

8. The method of claim 5 wherein the lower plenum has a front plenum branch to distribute air to the beginning of the conveyor and a rear plenum branch to distribute air to the end of the conveyor.

9. The method of claim 5 wherein the upper plenum has an upper front plenum branch to distribute air to the beginning of the conveyor and an upper rear plenum branch to distribute air to the end of the conveyor and wherein the lower plenum has a lower front plenum branch to distribute air towards the beginning of the conveyor and a lower rear plenum branch to distribute air towards the end of the conveyor.

10. The method of claim 9 further comprising the steps of providing:

an upper front heating element to heat air distributed by the front plenum branch and an upper rear heating element to heat air distributed by the rear plenum branch; and a lower front heating element to heat air distributed by the front plenum branch and a lower rear heating element to heat air distributed by the rear plenum branch.

11. The method of claim 10 further comprising the step of independently controlling the upper front heating element, the upper rear heating element, the lower front heating element and the lower rear heating element.

12. A system to independently and variably control the temperature profile of a conveyor oven comprising:

a conveyor oven having a cooking chamber;

two or more independently controllable blowers, comprising one or more upper blowers and one or more lower blowers;

an upper plenum, attached to an upper blower, to distribute air to the cooking chamber;

a lower plenum, attached to a lower blower, to distribute air to the cooking chamber; and one or more independently controllable heating elements to heat the air distributed by the one or more plenums;

wherein the temperature and volume of distributed air in the upper plenum are independently controllable from the temperature and volume of distributed air in the lower plenum.

* * * * *